US006575320B2

(12) United States Patent
Ota et al.

(10) Patent No.: US 6,575,320 B2
(45) Date of Patent: Jun. 10, 2003

(54) BOTTLE-TYPE PLASTIC CONTAINER WITH VACUUM ABSORPTION PANELS FOR HOT-FILL APPLICATIONS

(75) Inventors: Atsushi Ota, Koto-Ku (JP); Shinji Shimada, Koto-Ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/888,434

(22) Filed: Jun. 26, 2001

(65) Prior Publication Data

US 2002/0000421 A1 Jan. 3, 2002

(30) Foreign Application Priority Data

Jun. 30, 2000 (JP) ..... 2000-198036

(51) Int. Cl.[7] ..... B65D 1/02; B65D 23/00

(52) U.S. Cl. ..... 215/381; 215/382; 220/675

(58) Field of Search ..... 215/381–383, 215/900; 220/609, 675, 669, 666

(56) References Cited

U.S. PATENT DOCUMENTS 3,923,178 A * 12/1975 Welker, III ..... 215/381
4,805,788 A * 2/1989 Akiho ..... 215/381
4,863,046 A * 9/1989 Collette et al. ..... 215/381
4,976,798 A * 12/1990 Hoffman ..... 215/246 X
5,054,632 A * 10/1991 Alberghini et al. ..... 215/381
5,092,474 A * 3/1992 Leigner ..... 215/381
5,303,834 A * 4/1994 Krishnakumar et al. .... 215/381
5,704,503 A * 1/1998 Krishnakumar et al. .... 215/381
5,704,504 A * 1/1998 Bueno ..... 215/381
5,908,128 A * 6/1999 Krishnakumar et al. .... 215/381

FOREIGN PATENT DOCUMENTS

JP 07-172423 11/1995

* cited by examiner

*Primary Examiner*—Sue A. Weaver
(74) *Attorney, Agent, or Firm*—Oliff & Berridge, PLC

(57) ABSTRACT

A bottle-type plastic container has a body and an opening at one end of the container that allows liquid content to be filled into the container and emptied therefrom. The body includes at least one body portion having a substantially regular polygonal cross-section defined by a plurality of generally flat walls. The generally flat walls of the body portion include flexible walls and less-flexible walls, which are arranged alternately to each other in a circumferential direction of the body portion. When the container is filled with liquid contents at a high temperature and subsequently cooled to room temperature, a resultant pressure drop within the container is absorbed by the walls, initially by a primary inward deflection of the flexible walls and subsequently by a secondary inward deflection of the less-flexible walls. As such, the plastic container is particularly suited for hot fill applications.

20 Claims, 4 Drawing Sheets

BOTTLE-TYPE PLASTIC CONTAINER WITH VACUUM ABSORPTION PANELS FOR HOT-FILL APPLICATIONS

BACKGROUND OF THE INVENTION

1. Field of Invention

The present invention relates a bottle-type plastic container that can be filled with liquid contents at a high temperature.

2. Description of Related Art

When a bottle-type container of a blow-molded plastic material, such as PET, is filled with liquid content at a high temperature of 80–95° C., for example, it is generally inevitable that the shape of the container at its body changes significantly due to a pressure drop within the container. This occurs as a result of cooling of the contents to a room temperature. In the case of a bottle-type plastic container having a circular cross-section, for example, the peripheral wall of the body tends to be locally deflected inwards so that the original circular cross-section is deformed into a substantially triangular cross-section with rounded apexes. The appearance and/or commercial value of the product may be more or less impaired by the deformed cross-section of the body, even when the quality of the contents remains unchanged.

JP-A-07-172,423 discloses a bottle-type plastic container in which a pressure drop within the container is absorbed by an inward deflection of body walls that are provided with annular grooves having an arcuate cross-section. In this instance, the body is at least locally defined by relatively wide major surface walls formed with such annular grooves and relatively narrow, and substantially inflexible, corner walls. These walls are arranged alternately to each other to form a substantially quasi-octagonal cross-section. Those regions of the flexible major surface walls, which are circumscribed by the annular grooves, function as pressure change absorbing wall portions of the container.

The arrangement proposed in JP-A-07-172,423 proved to effectively absorb the pressure drop within the container having the above-mentioned particular cross-sectional shape. However, this measure may not always be applicable to eliminate the problem of the inward deflection of the body wall in a well-balanced manner, depending upon the cross-sectional shape of the body that may be designated by bottlers for enhancing an attractive appearance of the product, such as a substantially regular polygonal cross-sectional shape.

SUMMARY OF THE INVENTION

It would be desirable that a hot fill bottle-type plastic container filled with liquid content at a high temperature allows a well-balanced absorption of the pressure change within a container even when the body has a substantially regular cross-sectional shape.

To this end, according to the present invention, a bottle-type plastic container comprises a body and an opening at one end of the container that allows liquid contents to be charged into the container and emptied therefrom, wherein the body includes at least one body portion having a substantially regular polygonal cross-section defined by a plurality of generally flat walls. These walls of the body portion include flexible walls and less-flexible walls, which are arranged alternately in a circumferential direction of the body portion.

With the above-mentioned arrangement of the bottle-type plastic container according to the present invention, when the liquid contents initially filled at a high temperature are cooled to room temperature, a resultant pressure drop within the container is absorbed initially by a primary inward deflection of the flexible walls and subsequently by a secondary inward deflection of the less-flexible walls. Since the flexible walls and less-flexible walls of the body portion are arranged alternately to each other in a circumferential direction of the body portion, it is possible to effectively absorb the pressure drop within the container in a well-balanced manner, even when the body has a substantially regular cross-sectional shape.

The body may include a pair of body portions that are arranged in a longitudinal direction of the body one above the other. In this instance, it is preferred that the flexible walls and less-flexible walls of one body portion are arranged in alignment with the less-flexible walls and flexible walls of the other body portion, respectively.

It is preferred that the cross-section of the body portion is defined by a plurality of sides, the number of which is an even number of not less than four. Thus, for example, the body portion may have a substantially regular hexagonal cross-section.

The container according to the present invention may be formed by a conventional molding process, such as a biaxial orientation blow molding process or a direct blow molding process. The plastic material of the container may be one member selected from the group consisting of polyethylene terephthalate (PET) resin, polyamid resin, polycarbonate resin, polyacetal resin and polybuthylene terephthalate resin.

In the container according to the present invention, at least one body portion may be covered by a heat shrink label. Alternatively, or additionally, the plastic material of the container may form a laminated structure including a barrier layer.

BRIEF DESCRIPTION OF THE DRAWINGS

The present invention will be explained below in further detail, with reference to the preferred embodiments shown in the drawings, in which.

DETAILED DESCRIPTION OF PREFERRED EMBODIMENTS

Figure 1:
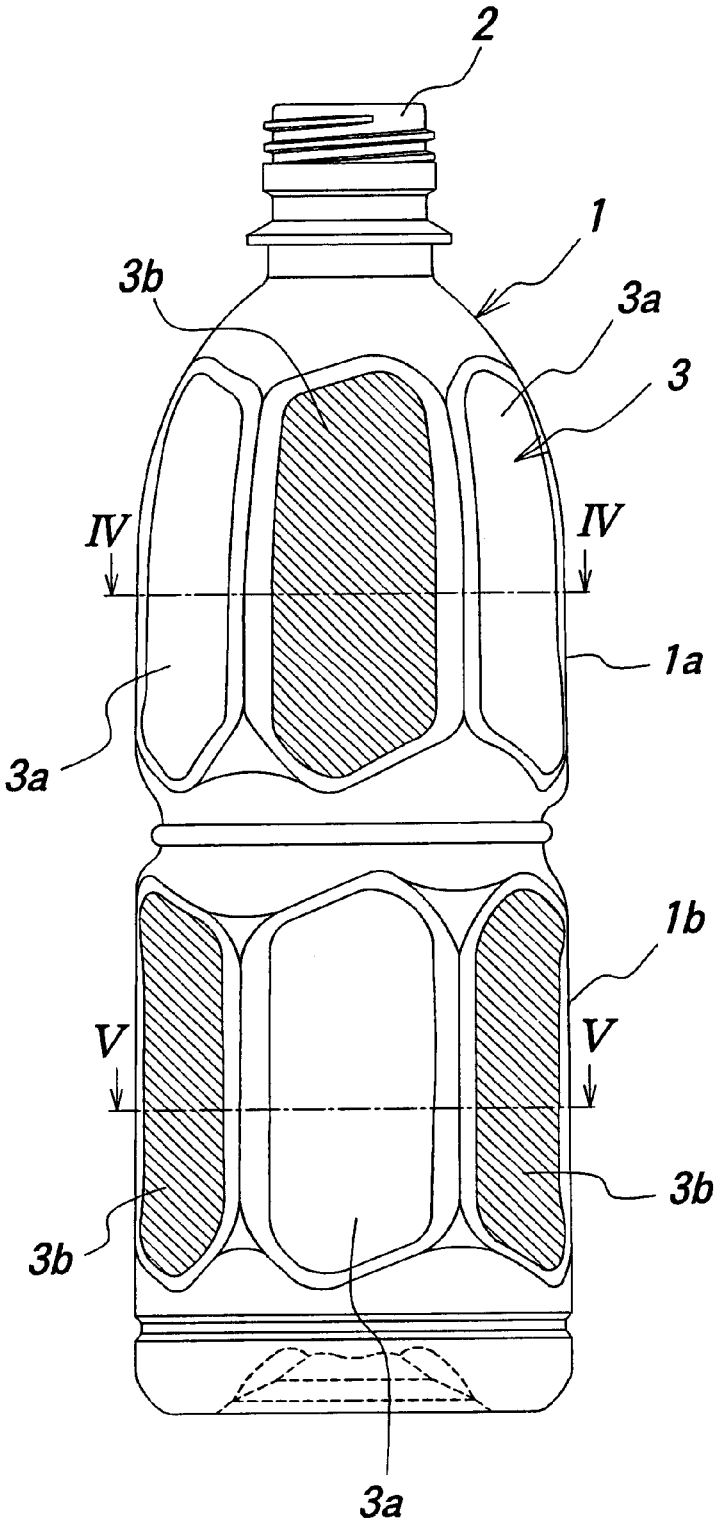
FIG. 1 is a front view of the bottle-type plastic container according to one embodiment of the present invention.
Figure 2:
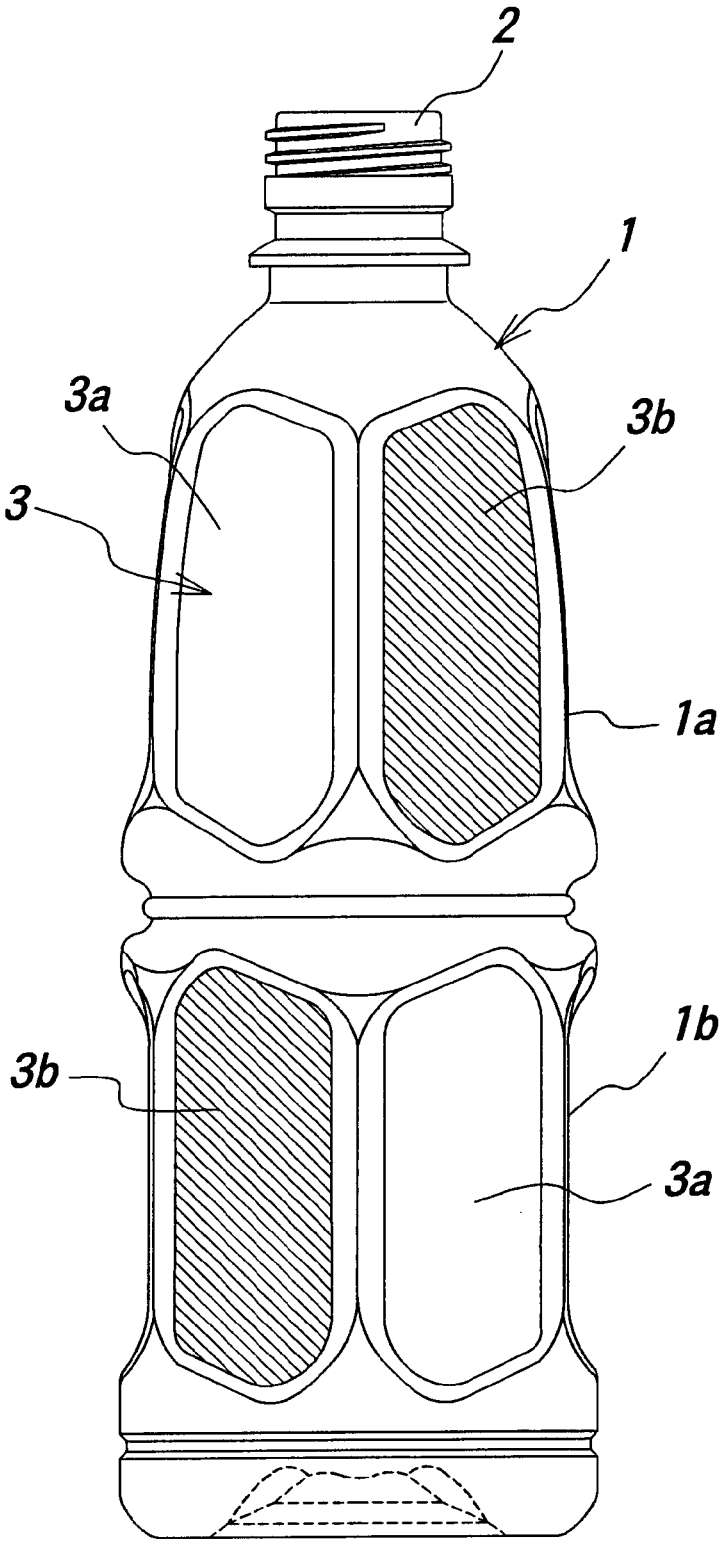
FIG. 2 is a diagonal view showing the container of FIG. 1.
Figure 3:
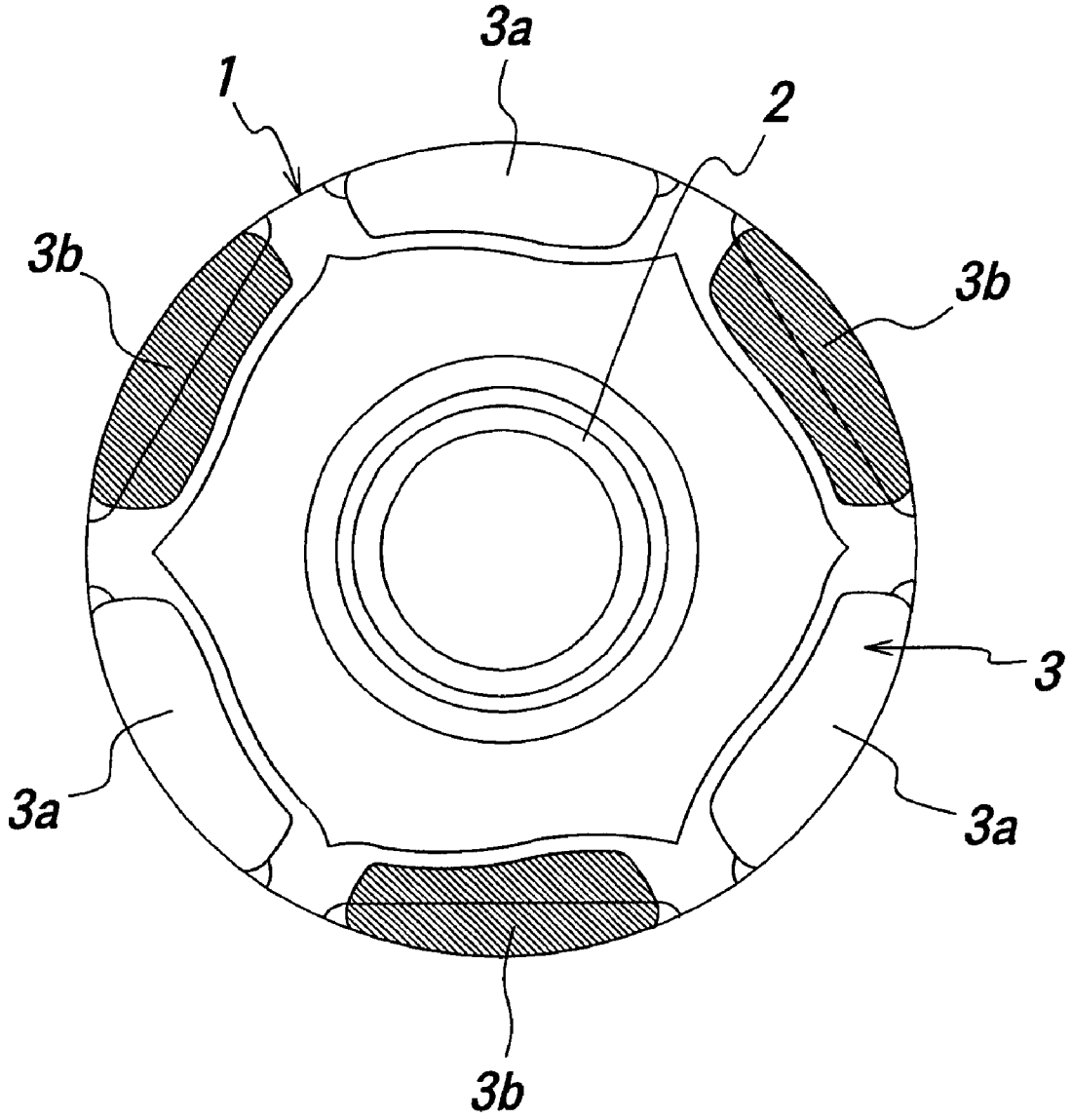
FIG. 3 is plan view of the container of FIG. 1.
Figure 4:
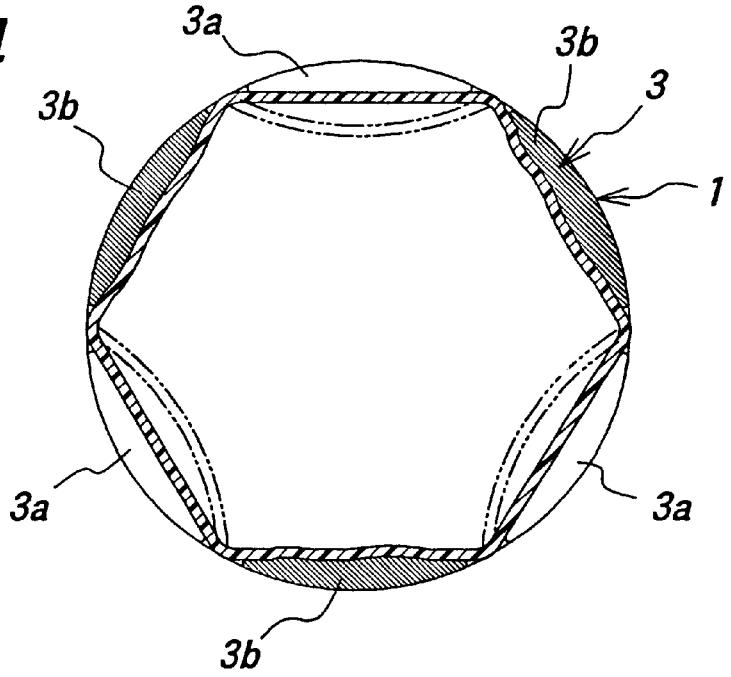
FIG. 4 is a sectional view taken along the line IV—IV in FIG. 1.
Figure 5:
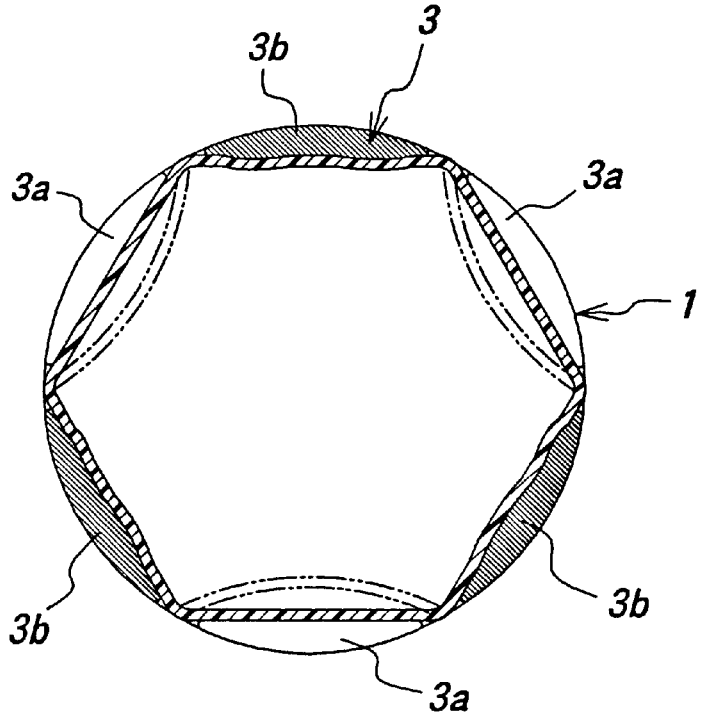
FIG. 5 is a sectional view taken along the line V—V in FIG. 1.

Referring now to FIGS. 1 to 5, there is shown a bottle-type plastic container according to one embodiment of the present invention. The container includes a body 1 having an upper body portion 1*a* and a lower body portion 1*b*. The container 1 has an opening 2 at an upper end region that allows the container to be filled with liquid contents and emptied therefrom.

The container according to the present invention may be made of an appropriate synthetic resin, typically polyethylene terephthalate (PET) resin. Alternatively, however, the container may be made from polyamid resin, polycarbonate resin, polyacetal resin, polybuthylene terephthalate resin or other synthetic resin having a sufficient resistance to chemicals. The container may be formed by known molding processes, such as a biaxial orientation blow molding process or a direct blow molding process.

Each body portion 1*a*, 1*b* has a substantially regular polygonal cross-section that is defined by a plurality of generally flat walls 3. Thus, in the case of the illustrated embodiment, the body portions 1*a*, 1*b* are of a regular hexagonal cross-section that is defined by six walls 3 having a substantially same width. The walls 3 includes three flexible walls 3*a* and less-flexible walls 3*b*, which are arranged alternately to each other in a circumferential direction of the body portions 1*a*, 1*b*. The flexible walls 3*a* may be flat walls, whereas the less-flexible walls 3*b* may be provided, for example, with a number of ribs that may extend in parallel to lessen flexibility. These ribs in the less-flexible walls 3*b* may be arranged obliquely or oriented in the longitudinal direction or circumferential direction of the container to provide a desired ornamental appearance of the container.

Also, in the container wherein a pair of the body portions 1*a*, 1*b* are arranged in a longitudinal direction of the body one above the other, as in the illustrated embodiment, it is highly preferred that the flexible walls 3*a* and less-flexible walls 3*b* of the upper body portion 1*a* are arranged longitudinally in alignment with the less-flexible walls 3*b* and flexible walls 3*a* of the lower body portion 1*b*, respectively.

With the above-mentioned arrangement of the bottle-type plastic container, when the liquid content filled into the container at a high temperature of 80–95° C., for example, is cooled to room temperature, the pressure within the container is reduced. Such a pressure drop is absorbed initially by a primary inward deflection of the flexible walls 3*a*, as shown by imaginary lines in FIGS. 4 and 5. The pressure drop within the container is subsequently absorbed by a secondary inward deflection of the less-flexible walls 3*b*. Since the flexible walls 3*a* and less-flexible walls 3*b* of the body portions 1*a*, 1*b* are arranged alternately to each other in the circumferential direction and also in the longitudinal direction of the container, it is possible to effectively absorb the pressure drop within the container in a well-balanced manner, even when the body 1 has a substantially regular cross-sectional shape.

It is to be noted that the above-mentioned arrangement of the bottle-type plastic container also serves to absorb a pressure increase within the container that occurs as the ambient temperature rises, by an outward deflection of the flexible walls 3*a* and less-flexible walls 3*b* of the body portions 1*a*, 1*b*.

In the container according to the illustrated embodiment, at least one body portion may be covered by a heat shrink label, which is not shown. The heat shrink label serves to reinforce the container particularly when it is of a thin-walled structure, and can also be used for ornamental purpose, etc. Alternatively, or additionally, the plastic material of the container may form a laminated structure including a barrier layer. The barrier layer serves to maintain the quality of the liquid contents within the container, particularly when the container is transparent or semitransparent.

It will be appreciated that the present invention provides an improved hot fill bottle-type plastic container that can be filled with liquid contents at a high temperature, allowing a well-balanced absorption of the pressure change within a container even when the body has a substantially regular cross-sectional shape. The improved container according to the present invention can be highly efficiently produced at a low cost, without requiring substantial changes to existing facilities.

While the present invention has been described above with reference to specific embodiments, it is needless to say that various changes and/or modifications are possible without departing from the scope of the invention.

What is claimed is:

1. A bottle-type plastic container comprising a body and an opening at one end of the container that allows liquid contents to be charged into the container and discharged therefrom, wherein said body includes at least one body portion having a substantially regular polygonal cross-section defined by a plurality of generally flat walls of substantially same dimensions, said generally flat walls including flexible walls and less-flexible walls, which are arranged alternately in a circumferential direction of the at least one body portion.

2. A bottle-type plastic container according to claim 1, wherein said body includes a pair of body portions that are arranged in a longitudinal direction of the body one above the other.

3. A bottle-type plastic container according to claim 2, wherein said flexible walls of one of said pair of body portions are arranged in alignment with said less-flexible walls of the other of said pair of body portions.

4. A bottle-type plastic container according to claim 1, wherein said cross-section of the body portion is defined by a plurality of sides, the number of which is an even number of not less than four.

5. A bottle-type plastic container according to claim 4, wherein said body portion has a substantially regular hexagonal cross-section.

6. A bottle-type plastic container according to claim 1, wherein said container is formed from a blow-molded plastic material.

7. A bottle-type plastic container according to claim 6, wherein said plastic material of the container is selected from the group consisting of polyethylene terephthalate resin, polyamid resin, polycarbonate resin, polyacetal resin and polybuthylene terephthalate resin.

8. A bottle-type plastic container according to claim 6, wherein said at least one body portion is covered by a heat shrink label.

9. A bottle-type plastic container according to claim 6, wherein said plastic material of the container forms a laminated structure including a barrier layer.

10. A bottle-type plastic container according to claim 1, wherein said container is a hot fill container filled with heated contents and the alternating flexible walls provide balanced initial absorption of pressure drop within said container due to a temperature drop of the contents.

11. A bottle-type plastic container according to claim 10, wherein the temperature of the heated contents is about 80° C. or more and when cooled to room temperature the alternating flexible walls are inwardly deflected to uniformly absorb the resultant pressure drop within said container.

12. A bottle-type plastic container comprising a body and an opening at one end of the container that allows liquid contents to be charged into the container and discharged therefrom, wherein said body includes first and second body portions that are arranged in a longitudinal direction of the body one above the other, said body portions each having a substantially regular polygonal cross-section defined by a plurality of generally flat walls of substantially same dimensions, said generally flat walls of each said body portion including flexible walls and less-flexible walls, which are arranged alternately in a circumferential direction of the body, wherein said flexible walls of the first body portion are arranged in alignment with said less-flexible walls of the second body portion.

13. A bottle-type plastic container according to claim 12, wherein said cross-section of the first and second body portions is defined by a plurality of sides, the number of which is an even number of not less than four.

14. A bottle-type plastic container according to claim 13, wherein said body portions have a substantially regular hexagonal cross-section.

15. A bottle-type plastic container according to claim 12, wherein said container is formed from a blow-molded plastic material.

16. A bottle-type plastic container according to claim 15, wherein said plastic material of the container is selected from the group consisting of polyethylene terephthalate resin, polyamid resin, polycarbonate resin, polyacetal resin and polybuthylene terephthalate resin.

17. A bottle-type plastic container according to claim 12, wherein at least one of said first and second body portions is covered by a heat shrink label.

18. A bottle-type plastic container according to claim 12, wherein the container is made of a plastic material that forms a laminated structure including a barrier layer.

19. A bottle-type plastic container according to claim 12, wherein said container is a hot fill container filled with heated contents and the alternating flexible walls provide balanced initial absorption of pressure drop within said container due to a temperature drop of the contents.

20. A bottle-type plastic container according to claim 19, wherein the temperature of the heated contents is about 80° C. or more and when cooled to room temperature the alternating flexible walls are inwardly deflected to uniformly absorb the resultant pressure drop within said container.

* * * * *